US005598684A

United States Patent [19]

Aarts

[11] Patent Number: 5,598,684

[45] Date of Patent: Feb. 4, 1997

[54] VACUUM PACKAGE, METHOD AND APPARATUS FOR MAKING SUCH VACUUM PACKAGE FILLED WITH GRANULAR MATERIAL

[75] Inventor: Mathias L. C. Aarts, Bilthoven, Netherlands

[73] Assignee: Sara Lee/De N.V., Utretcht, Netherlands

[21] Appl. No.: 616,768

[22] Filed: Mar. 15, 1996

Related U.S. Application Data

[63] Continuation of Ser. No. 196,832, Feb. 15, 1994, abandoned.

[30] Foreign Application Priority Data

May 4, 1993 [NL] Netherlands ..... 9300754
Feb. 7, 1994 [NL] Netherlands ..... 9400194

[51] Int. Cl.[6] ..... B65B 31/08; B65B 1/24

[52] U.S. Cl. ..... 53/434; 53/131.2; 53/136.3; 53/411; 53/415; 53/436; 53/512; 53/526; 53/527

[58] Field of Search ..... 53/131.2, 135.1, 53/135.2, 136.3, 136.5, 405, 432, 434, 436, 411, 415, 478, 510, 512, 526, 527

[56] References Cited

U.S. PATENT DOCUMENTS

| | | | |
|---|---|---|---|
| 2,259,866 | 10/1941 | Stokes | 53/415 |
| 2,506,056 | 5/1950 | Bergstein | 53/411 X |
| 2,870,954 | 1/1959 | Kulesza | 53/432 X |
| 3,216,172 | 11/1965 | Piazze | 53/512 X |
| 3,382,642 | 5/1968 | Shaw . | |
| 3,641,726 | 2/1972 | Cassina . | |
| 3,656,682 | 4/1972 | Giuliani | 53/478 X |
| 4,534,154 | 8/1985 | Gaubert | 53/434 X |
| 4,727,706 | 3/1988 | Beer | 53/434 |
| 4,734,292 | 3/1988 | Van Boxtel | 53/434 X |
| 4,920,726 | 3/1990 | Yamada et al. | 53/136.5 X |
| 4,927,075 | 5/1990 | Lisiecki | 53/478 X |
| 4,949,529 | 8/1990 | Davis | 53/411 X |
| 5,220,768 | 6/1993 | Aarts | 53/436 X |
| 5,228,270 | 7/1993 | Aarts | 53/432 |
| 5,339,604 | 8/1994 | Aarts | 53/432 |
| 5,351,463 | 10/1994 | Aarts | 53/434 |

FOREIGN PATENT DOCUMENTS

| | | | |
|---|---|---|---|
| 0361711 | 4/1990 | European Pat. Off. . | |
| 0445390 | 9/1991 | European Pat. Off. . | |
| 0475514 | 3/1992 | European Pat. Off. . | |
| 666799 | 8/1952 | United Kingdom | 53/434 |
| 1064422 | 4/1967 | United Kingdom | 53/436 |

*Primary Examiner*—Daniel Moon
*Attorney, Agent, or Firm*—Longacre & White

[57] ABSTRACT

The invention relates to a method and apparatus for producing a vacuum package filled with granular material. A package made from a flexible film is filled with granular product. The filled package is compressed, so that the contents form a compact whole. Then the compressed package is evacuated by means of a vacuum element which is connected to a small suction opening in the wall of the package, while the rest of the package is not subjected to vacuum.

29 Claims, 8 Drawing Sheets

VACUUM PACKAGE, METHOD AND APPARATUS FOR MAKING SUCH VACUUM PACKAGE FILLED WITH GRANULAR MATERIAL

This is a continuation of application Ser. No. 08/196,832, filed Feb. 15, 1994, which was abandoned upon the filing hereof.

BACKGROUND OF THE INVENTION

1. Field of the Invention

This invention relates to a method for making a vacuum package filled with granular product, in which a package made from a flexible packaging material and filled with a granular product is evacuated and sealed hermetically.

2. Description of the Related Art

A method of vacuum packing material disclosed in U.S. Pat. No. 4,845,927. According to this known method, a package open at the top is produced from a sheet of flexible film and subsequently filled with a loose granular material. The filled package is placed in a vacuum chamber in which the package is subjected to vacuum. After the package has attained the desired degree of vacuum, the package is heat-sealed at the top using welding jaws arranged in the vacuum chamber. The package, now hermetically sealed, is then removed from the vacuum chamber.

From the point of view of efficiency and economy, it is desired that the volume of the vacuum chamber be kept as small as possible. Accordingly, the volume of the package to be evacuated is preferably made as small as possible by already folding up the filled package as much as possible before it is placed in the vacuum chamber. Moreover, in that case it is not necessary to arrange folding means in the vacuum chamber. In that case, the vacuum chamber need only contain the welding jaws which are necessary to hermetically seal the package which is already folded up completely. This means that the package is evacuated through a narrow gap left open in the top of the package. While the package is being evacuated in a short time, a high outflow velocity of gasses to be removed from the package arises in the gap. In the case of a granular structure of the filling in the package, in particular if the filling is fine-granular or in powder form, a problem occurs in that granules of material are sucked from the package and find their way into the vacuum chamber and contaminate it. The entrained granules may also stick to the inside wall at the top of the package, thereby impeding the sealing of the package and causing leakages.

SUMMARY OF THE INVENTION

The object of the present invention is to improve the above-mentioned known method, and to that end provides a method for making a vacuum package filled with granular product, in which a package produced from a flexible packaging material and filled with a granular product is evacuated and sealed hermetically, characterised in that the package, before being evacuated, is compressed by applying pressure to the sidewalls of the package, so that the granular product forms a compact whole, that subsequently a vacuum element is connected to a suction opening provided in a wall of the package, this vacuum element evacuating the package without the package being otherwise externally subjected to vacuum, and that after the evacuation the suction opening is sealed hermetically.

According to the invention, the package, before being evacuated, is brought under an external pressure compressing the package such that the granular filling becomes a compact whole, i.e. the granules are no longer loosely moveable relative to each other. As a result, during evacuation the granules can no longer be sucked from the package. Further, it is possible to evacuate the package through a very slight suction opening therein, for instance a pin hole. Further, it is for instance possible to first fold up the filled package completely, including the top face, in an atmospheric environment, so that the production of the package, except for the evacuation, can take place entirely outside the vacuum chamber and thereby permits of access and proper control. It is possible to provide the suction opening in the package not until after the hermetic sealing thereof, for instance at evacuation. On the other hand, it is also possible to provide the suction opening previously, for instance during the production of the packaging material. In addition, the suction opening, if so desired, can be provided in the yet unfilled package, in particular when measures have been taken to prevent egress of the still loose granular material from the filled package, for instance by providing a welding strip, to be discussed hereinafter, under the suction opening. Since the suction opening need only be a small hole, the certainty that the package will not leak at the sealed opening is greater than in the case of a relatively large seal over the full width of the package.

An important further advantage of compressing the package is that thereby the free volume to be evacuated of the package between the granules is reduced to a large extent. As a consequence, and because it is no longer necessary to use a large vacuum chamber which is to accommodate the entire package as in the known method, a large saving of required vacuum capacity is obtained and moreover a very short evacuation time is possible. Only the suction opening is connected to a vacuum line, and the rest of the package remains in the atmospheric environment.

The suction opening can be pierced in the package by a reciprocating needle mounted in the vacuum element. There is a large measure of freedom in the choice of the location of the suction opening in the package. It is no longer necessary that the suction opening be located in the top face of the package, but if desired the suction opening may also be provided in the sidewalls or even the bottom of the package.

The compression of the package can be implemented in various ways.

According to one method, a rigid, plate-shaped element is placed against each side wall of the package, which element is pressed against the package mechanically or otherwise. The plate-shaped elements can be movably interconnected, for instance by means of springing hinges, and may thereby form a shell enclosing the package relatively tightly. Optionally, it is also possible for a bottom plate to be movably connected with the side plates so as to form a kind of holder into which the package fits.

According to a different and preferred method, the package, for the purpose of the compression, is placed in a bag-shaped body made from elastic material and of double-walled design. By supplying compressed air between the double walls of the bag-shaped body, the inner wall of the bag-shaped body is pressed against the package.

The two methods can also be combined, such that the plate-shaped elements or the holder formed therefrom are placed between the inner wall of the bag-shaped body and the exterior of the package and the plates are pressed against the package by inflating the bag.

An additional advantage of compressing the package, which takes place when the filling is still loose and hence movable, is that the walls of the finished package acquire a smoother appearance than the relatively rough surface normally acquired by a vacuum package with granular contents.

If, as is usual, the package possesses a rectangular shape, preferably not only the sidewalls but also the top surface and the bottom surface are pressed towards each other. This can for instance be effected by arranging a supporting plate on the free end face of the package remote from the other end face proximal to the bottom of the bag-shaped body referred to. In that case, as the bag-shaped body is being inflated, the package is also compressed between the bottom of the bag and the supporting plate.

In order for the suction opening to be sealed after the evacuation of the package, a sealing strip may be provided under the suction opening, between the inside wall of the package and the filling. The sealing strip, along the edges thereof, is fixedly connected to the inside wall of the package. Provided in the zone of the sealing strip and located between the edges thereof and the suction opening in the package are openings through which communication between the suction opening and the interior of the package continues to exist during evacuation. After evacuation, the sealing strip is sealed around the suction opening to the inside wall of the package in known manner, whereafter the vacuum element can be removed from the package and the package is entirely sealed hermetically. The welding element may for instance be formed by an annular welding jaw placed around the connection of the vacuum element. Because upon compression the filling forms a compact and hard whole, the filling can serve as a support for the sealing strip during sealing without requiring that the sealing strip on the inside of the package be supported with additional means.

The suction opening can also be designed as the opening of a non-return valve provided in the wall of the package, permitting outflow of air from the package and blocking inflow of air into the package. If desired, after evacuation, on the exterior of the package a sealing strip can be welded or an adhesive strip can be fitted over the suction opening to provide additional protection against leakage.

In yet another embodiment of the invention, the suction opening used is the narrow gap formed between two portions of the packaging film folded onto each other, for instance the gap-shaped opening formed between film portions when portions of the sidewalls of the package located above the filling are folded over onto each other, as is required for forming the top face of the package. After the air has been sucked from the package through the gap, the gap is sealed. To this end, the film, at least at the location of the gap, may be provided with a firmly sealable coating layer which, upon the abovementioned folding over of the film, comes to be located between the two film portions located on each other. By means of electrically heated welding jaws which are pressed onto the folded portion of the film adjacent the gap, the two superposed film portions are welded together whereby the package is entirely sealed hermetically.

Since as a result of the compaction of the filling through the compression, the volume to be evacuated is considerably smaller than in the case of a non-compacted package, and the residual gasses can be sucked from the package at a high velocity without the granules being entrained from the package, the evacuation can be implemented in a short time, for instance in just two seconds in the case of a 250 gram package of ground coffee, as opposed to approximately 12 seconds previously. Also, the energy required for evacuation is drastically reduced. For instance, instead of an 18 kW vacuum pump, a 1 kW vacuum pump can be sufficient.

A further object of the present invention is to provide a particular embodiment of the method, whereby portions on the package provided with informational characters remain properly legible for a human or electronic observer. With the commonly known vacuum package, upon evacuation generally a rough appearance is obtained, even if the package is made from a smooth sheet of packaging material, owing to the fact that the thin-walled packaging material, such as paper or aluminium foil, is pressed against the granular contents of the package as a result of the difference in pressure between the atmospheric outside air and the vacuum in the package. The typically block-shaped and rectangular package is usually provided with printed text, figures, marks, a bar code, a date, manufacturing data and the like, which will be referred to hereinafter as informational characters. Typically, these informational characters are already provided on the packaging material supplied in the form of a sheet, before a package is folded from a sheet. Owing to the rough, bumpy structure of the surface of the packaging material in the finished package, the informational characters present are deformed and thereby rendered more difficult to read or poorly identifiable. If, for instance, the package is provided with a bar code which is to be read electronically, reading errors will occur as a result of the circumstance that the separate and closely spaced bars of varying thickness do not accurately maintain their relative position and lose their rectilinearity.

According to a particular aspect of the invention, these problems are obviated in that, at the location on the packaging material of the package where the informational characters are located, a reinforcement zone is provided between the packaging material and the granular product before the package is evacuated, so that at that point the roughness of the surface of the packaging material upon evacuation is reduced and the legibility of the informational characters is improved.

It is known to solve these problems by enveloping the package with a second, smooth wrapping which is not under vacuum but remains in communication with the outside air; this second wrapping remains smooth, so that any informational characters on this second wrapping remain properly legible. The drawback of this known solution is that an additional wrapping is required, which renders the package more expensive and is environmentally undesirable.

This same drawback applies if the packaging material used is a little flexible and relatively thick singular or composite film which possesses a higher degree of natural stiffness and is therefore better resistant to deformation in the vacuum package. Yet another solution is to subject the package to an aftertreatment, whereby the unevennesses in the package are reduced or removed. However, the aftertreatment constitutes an additional process step which is preferably avoided in order to keep the production of the package as simple as possible.

According to a highly advanced aspect of the invention, the package, before being evacuated, is formed from at least two different sheets of packaging material, at least one basic sheet determining at least substantially the outward form of the package and at least one insert sheet being connected to the basic sheet adjacent its circumferential edges in a manner at least substantially non-overlapping with respect to the basic sheet. A package produced according to this method provides many advantages. Thus, it is for instance possible to fold the basic sheet into a shell having two open ends, to hermetically connect an edge of the basic sheet extending in the longitudinal direction of the shell to subjacent material of the basic sheet, to fold over a portion of the basic sheet adjacent a first open end of the shell and to hermetically connect the insert sheet to the folded-over portion of the basic sheet. In that case, the insert sheet forms, for instance, the bottom of the package. Thus, depending on the dimensions of the package, a saving of packaging material of, for instance, 5–10 percent compared with conventional packages can be realised. After the manufacture of the bottom, the package can subsequently be filled with the granular product through its second open end, whereafter the second open end is folded up and sealed hermetically, followed by evacuation of the package as discussed hereinabove. The second open end can be folded up and sealed hermetically according to a method which is known per se.

Preferably, however, the package is filled with the granular material through its second open end, whereafter a portion of the basic sheet is folded over adjacent the second open end of the shell and a second insert sheet is hermetically connected to the folded-over portion, followed by evacuation of the package as discussed hereinabove. Thus, a comparable film saving is realised at the top of the package as well.

In particular, the basic and insert sheets are made of different types of packaging material or film. It has been found that a package having the insert bottom described is better adapted to stand open than a package with a conventional bottom. In this connection, it is then possible, for instance, to use a thinner film for the insert sheet than for the basic sheet.

The present invention also encompasses an apparatus for making a vacuum package filled with a granular material, comprising a vacuum element for evacuating a package made from a flexible packaging material, such as for instance a film, and filled with granular material, and closing means for hermetically sealing the filled package, characterised in that the apparatus further comprises pressure means for applying pressure to at least the sidewalls of the closed package, so that the granular filling forms a compact whole, and that the vacuum element is adapted for connection to a suction opening, provided in a wall of the closed and compressed package, for evacuating the package not otherwise subjected to vacuum, and that the closing means are adapted for hermetically sealing the suction opening.

The present invention further relates to a vacuum package made from a flexible packaging material, filled with a granular material and evacuated by a method according to the invention.

In accordance with a particular embodiment of the invention, the package is provided with a hermetically sealed suction opening. More particularly, the vacuum package is characterised in that, at the location on the packaging material where informational characters are located, a reinforcement zone is provided between the packaging material and the filling, so that at that point the roughness of the surface of the packaging material is reduced and the legibility of the informational characters is improved.

According to a highly advantageous embodiment, the package is made up of at least two sheets of a film-like packaging material, of which at least one basic sheet determines at least substantially the outward form of the package and at least one insert sheet which is hermetically connected to the basic sheet adjacent its edges in a manner substantially non-overlapping at least with regard to the basic sheet.

BRIEF DESCRIPTION OF THE DRAWINGS

The present invention will be further explained, by way of example only, with reference to the accompanying diagrammatic drawings. In the drawings.

DESCRIPTION OF THE PREFERRED EMBODIMENTS

Figure 1:
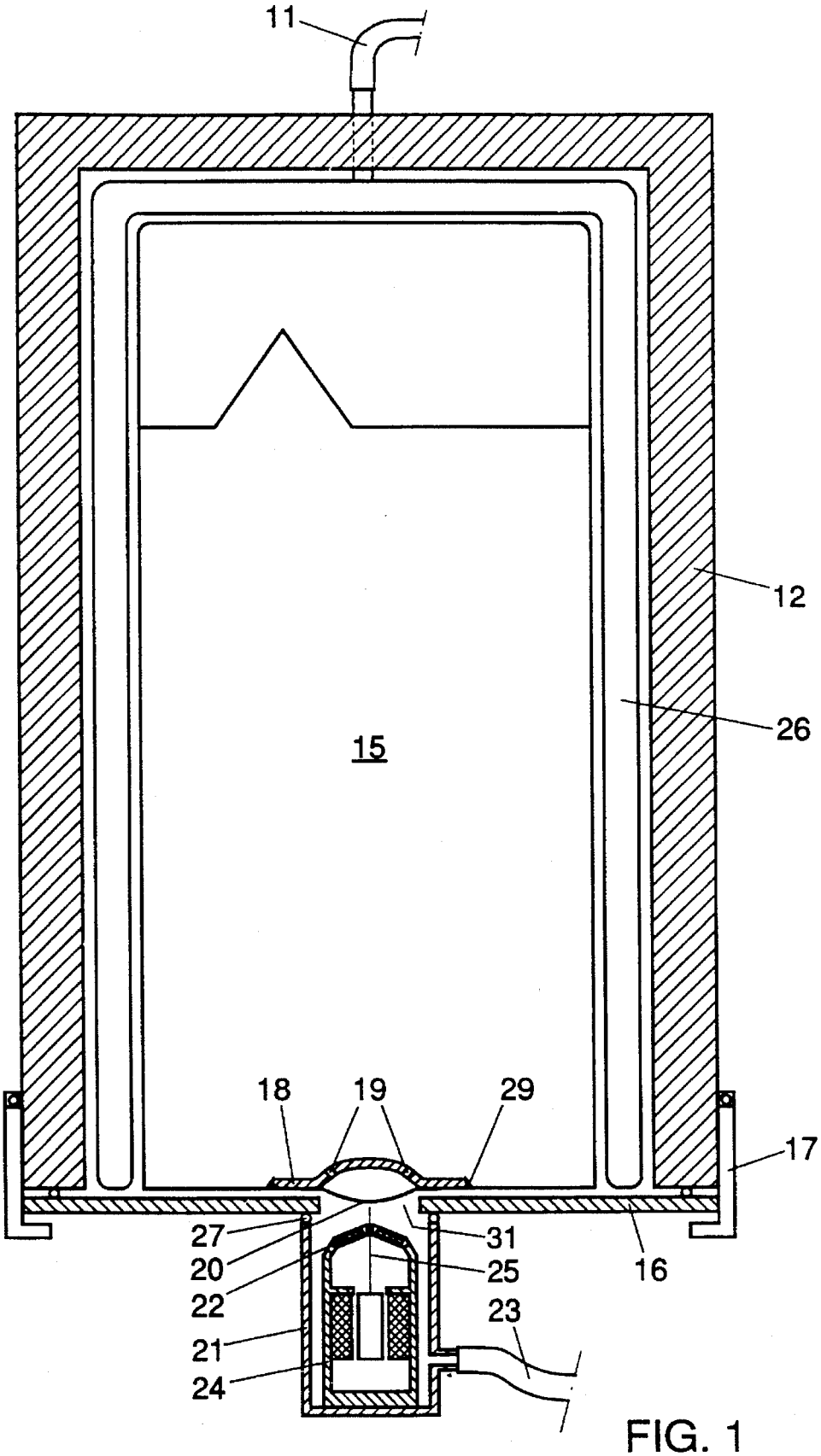
FIG. 1 shows an apparatus according to the invention with a vacuum element connected thereto, partly in vertical section.
Figure 3:
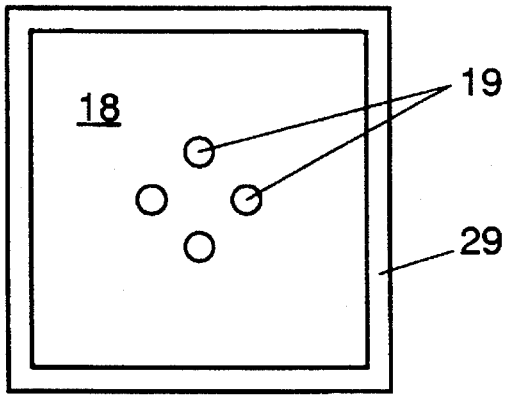
FIG. 3 shows a sealing strip as provided against the inside wall of the vacuum package to be produced with the apparatus according to FIG. 1.

FIG. 1 shows a rigid chamber 12, open at one end, arranged with the open end facing downward. Located within the chamber with some clearance is a bag-shaped body, in this case designed as a double-walled rubber bag 26. Connected to the bag is a compressed air line 11 for supplying compressed air to the interior of the bag and thereby inflating the bag. Connected to the lower end of the chamber are hinging clamps 17 by which a supporting plate, in this case cover 16, can be clamped hermetically against the chamber. A package 15 is placed within the bag with some clearance. The package 15 is made from a flexible packaging film, such as thermoplastic film or paper and is filled entirely with a granular product, for instance (fine-)ground coffee. The package is closed but not yet subjected to vacuum. The cover 16 is provided with a centrally located opening 31. At the location of the opening 31, a sealing strip 18 has been welded along the edges 29 to the inside wall of the package. The sealing strip is provided with a number of openings 19 located within the strip edges but off the centre (see also FIG. 3).

The apparatus further comprises a vacuum element 21 adapted to be connected hermetically to the cover 16 over the opening 31 by means of a sealing ring 27. The interior of the vacuum element is connected to a line 23 which is connected with a vacuum pump. Located within the vacuum element is a welding element 24 which, at the end proximal to the opening 31 in the cover, is provided with an annular sealing jaw 22 which can be heated electrically. The welding element can reciprocate within the vacuum element, i.e. be moved toward the opening 31 and away from the opening 31. Located within the welding element 24 is a needle 25 capable of reciprocating relative to the sealing jaw 22 through a central opening in the welding jaw by means of an electromagnet.

Figure 2:
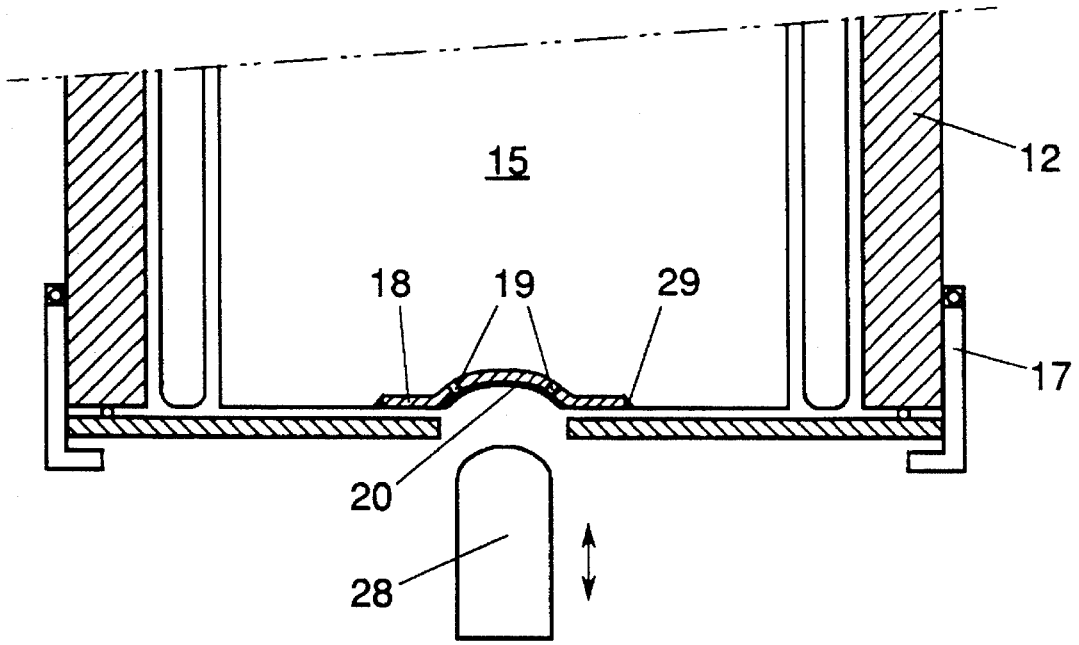
FIG. 2 shows the lower part of the apparatus according to FIG. 1 at a time when the vacuum element is not connected yet.

The apparatus according to FIG. 1 is used as follows. First, the package 25, completely filled and hermetically sealed but not yet evacuated, is fitted into the bag 26 (or the chamber 12 with the bag 26 is fitted over the package) at this point, the cover 16 and the vacuum element 21 have not been arranged yet when the package is disposed in the bag, the cover 16 is placed on the chamber 12 and pressed hermetically against the edges of the chamber by means of the hinging clamps 17. Then a punch 28 (FIG. 2) is inserted through the opening in the cover. The punch 28 is moved up so far that the convex front end thereof presses the film at that location and also the sealing strip 18 located behind it in upward direction to a slight extent (FIG. 2). In this position the punch is fixed. Now compressed air is supplied to the bag 26 which expands as a result, the outer wall of the bag settling against the inside wall of the chamber and the inner wall of the bag being pressed against the package. The "bottom" of the bag thereby presses the package against the cover 16 and also against the punch 28 located in the opening thereof, so that the package is compressed on all sides. The package is compressed to such an extent as is necessary to reduce the relative mobility of the granules such that upon the evacuation to follow later on no granules can be sucked from the filling. The punch 28 is now removed from the opening 31 and from the cover, and the vacuum element 21 is then connected to the cover 16. By way of the vacuum line 23, the interior of the vacuum element is evacuated. Upon commencement of the vacuum suction, the film 20 at the opening 31 is to a slight extent sucked towards the vacuum element, thereby moving away from the sealing strip. Owing to the openings 19 present in the sealing strip, no difference in pressure on either side of the sealing strip is produced, so that it retains the position assumed. The electromagnet operating the needle 25 is now activated, so that the needle is moved outwardly and pierces a hole in the film. In this process the needle does not touch the sealing strip 18. This is the situation as depicted in FIG. 1. During the continued evacuation the contents of the package are subjected to vacuum via the hole in the film serving as suction opening and through the openings 19 in the sealing strip. After the desired degree of vacuum in the package has been obtained, the sealing element is activated, pressing the film 20 and the sealing strip against each other and welding them together by means of the heated sealing jaw 22. In this process, the sealing strip is supported by the filling which has become hard as a result of the compression of the package and the vacuum. Because the film and sealing strip are welded together in a zone within the openings 19 in the welding strip, an airtight closure of the package is obtained at that location. The compressed air pressure on the bag is now removed, so that the bag shrinks again. If desired, at this point a vacuum source can be connected to the interior of the bag so that the bag shrinks to an even higher degree and the package can more readily be removed from the bag. The vacuum element can now be removed from the cover and likewise the cover can be removed from the chamber. The package now finished is removed from the bag and replaced with a next package to be evacuated. It is observed that during the entire evacuation process the exterior of the package, with the sole exception of the small area opposite the opening 31 in the cover, is not subjected to vacuum and remains in an atmospheric environment.

In the foregoing it has been described how a small suction hole can be provided in the filled package already entirely closed hermetically. However, it is also possible to priorly pierce a hole in the packaging film, serving as suction hole, and subsequently to provide the sealing strip over the hole. Owing to the minor dimensions of the suction opening in the film and of the openings in the sealing strip, which moreover do not overlap, no granular product will escape from the package during the filling and compression of the package. In this case, the vacuum element 21 need not be provided with a moveable needle 25.

Figure 4:
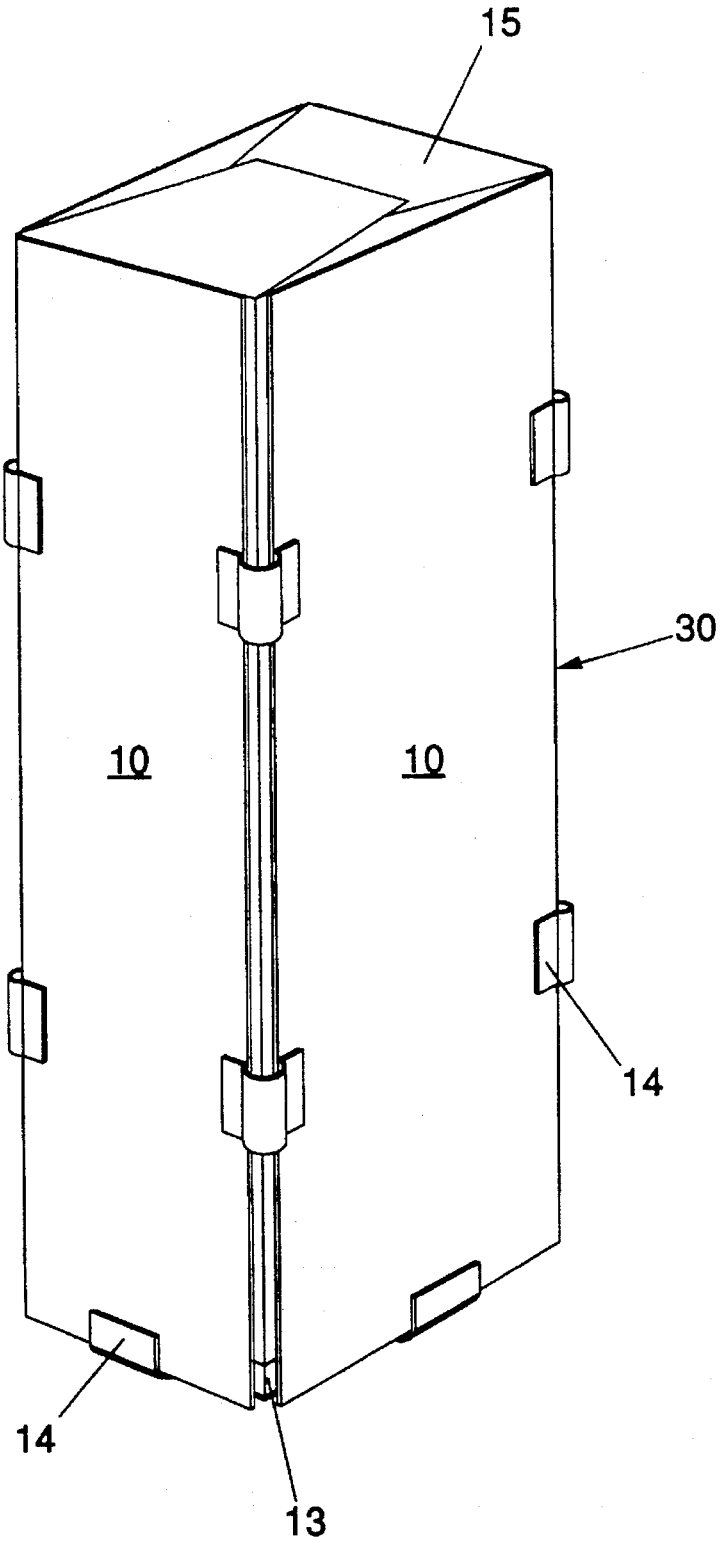
FIG. 4 shows a holder for the vacuum package to be manufactured for optional use in the apparatus according to FIG. 1.

According to a variant of the above-mentioned method, a holder 30 (FIG. 4) is placed in the bag. The holder is made up of four metal side plates 10 and a metal bottom plate 13. The plates 10 and 13 are interconnected through springing hinges 14. The hinges allow a slight back-and-forth movement of the plates. The holder is placed in the bag, with the bottom plate upwards against the bottom of the bag. The package is fitted into the holder before or after the holder has been arranged in the bag. As the bag is being inflated, it presses the plates 10, 13 against the package, so that the package is compressed. Inserting and removing the package into or from the holder 30 is normally easier than in the case where the package is placed directly into the bag 26.

Figure 5:
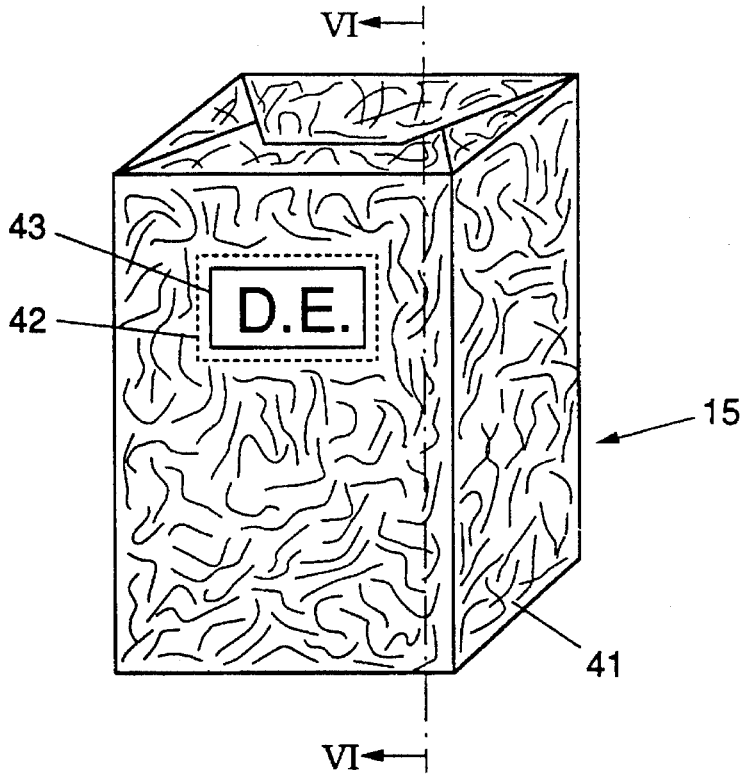
FIG. 5 is a perspective view of an embodiment of a vacuum package manufactured with the apparatus of FIG. 1.

FIG. 5 shows a possible embodiment of the vacuum package 15, in this case blocked-shaped and rectangular, filled with, for instance, 215 g coffee beans or ground coffee and under a reduced pressure of, for instance, 100 mbar. The package 15 is made from, for instance, at least one thin-walled sheet of smooth synthetic film and evacuated by means of the apparatus of FIG. 1. The package 15 generally shows roundabout a rough surface 41 because the packaging material is pressed against the granular contents by the outside air. An exception to the rough surface is formed by a rectangular portion 52 which has remained smooth and where characters are provided on the packaging material.

Figure 6:
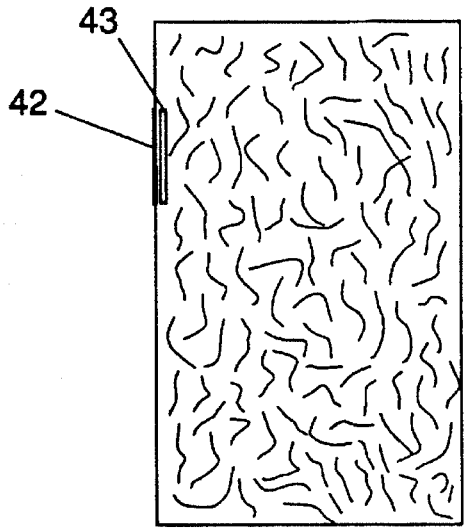
FIG. 6 is a vertical section taken on the line A—A in FIG. 5.

As can be seen better in FIG. 6, a plate-shaped element, here formed by a cardboard card 43 of corresponding dimensions to those of the portion 42, is located between the smooth portion 42 and filling of the package. The presence of the card 43 prevents the package acquiring a rough surface at the location of the card.

For the purpose contemplated, the card need only extend under the area on the package that comprises the informational characters. If so desired, for practical reasons, the card may extend to a greater or lesser extent beyond the zone with informational characters as well. For instance to prevent displacement of the card during or after the filling of the still open package, the card may extend in lateral direction from the left-hand sideline to the right-hand sideline of a wall. If an entire wall is provided with text, the plate-shaped element may extend over the entire wall. Preferably, however, the plate-shaped element should not extend beyond the sideline mentioned into an adjacent wall, nor should the single element extend over three or more walls. If two or more walls of the package are provided with informational characters, each wall may be provided with a separate plate-shaped element. In general, for economic reasons, it is desired that the card or other plate-shaped element be not made much larger than the portion of the wall or walls of the package that is provided with informational characters.

Before the package is closed and vacuumized, the loose card can be slipped into the package during or after the filling thereof. It is also possible for the card to be adhered to the as yet unfolded flat sheet of packaging material at the required points beforehand. The card can be made from cardboard as well as any other material suitable for the purpose, for instance thin-walled metal or plastics.

Figure 7:
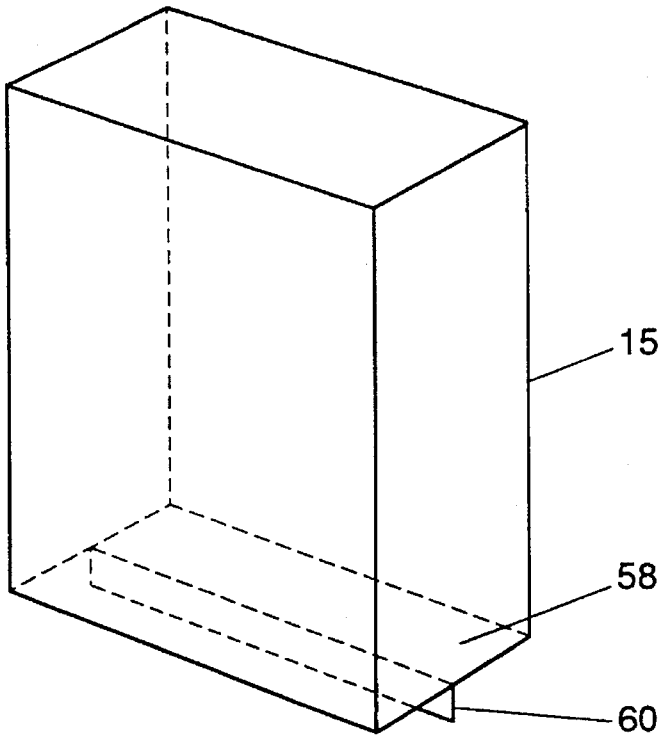
FIG. 7 is a perspective view of a first embodiment of a vacuum package manufactured with the apparatus of FIG. 1.
Figure 8:
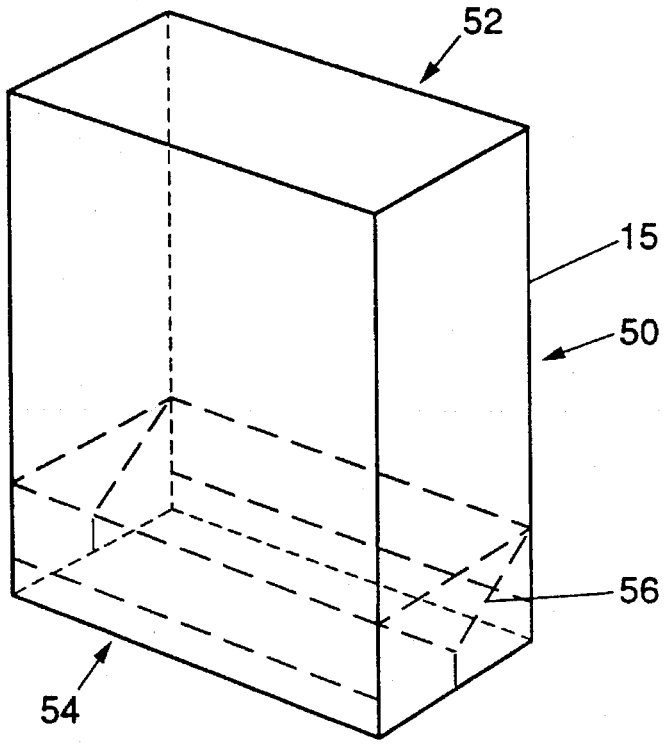
FIG. 8 is a perspective view of an intermediate of the vacuum package of FIG. 7.

FIG. 7 shows a first possible embodiment of a package 15 which is not finished yet, i.e. it has not yet been evacuated and sealed hermetically by means of the apparatus of FIG. 1. The package 5 of FIG. 7 consists of a flexible packaging film in the form of a shell 50. FIG. 8 shows the open shell 50 with two open ends 52, 54, from which the as yet unfinished package of FIG. 7 is produced, i.e. before a bottom is arranged in the package. At the open end 54, fold lines 56 are indicated by broken lines, along which a part of the shell 50 can be folded for obtaining a bottom 58 of the package 15. FIG. 7 shows the bottom 58 which has been obtained by folding the shell 50 along the fold lines 56. The bottom 58 can be rendered properly airtight by sealing the upright edge 60 of the shell 50 with closing means which are known per se, such as, for instance, a welding device. Thereafter the package 15 can be filled, closed and evacuated as described hereinbefore. The closure of the open end 52 at the top of the package 15 can of course be implemented entirely analogously to the manner in which the open end 54 is closed.

Figure 9:
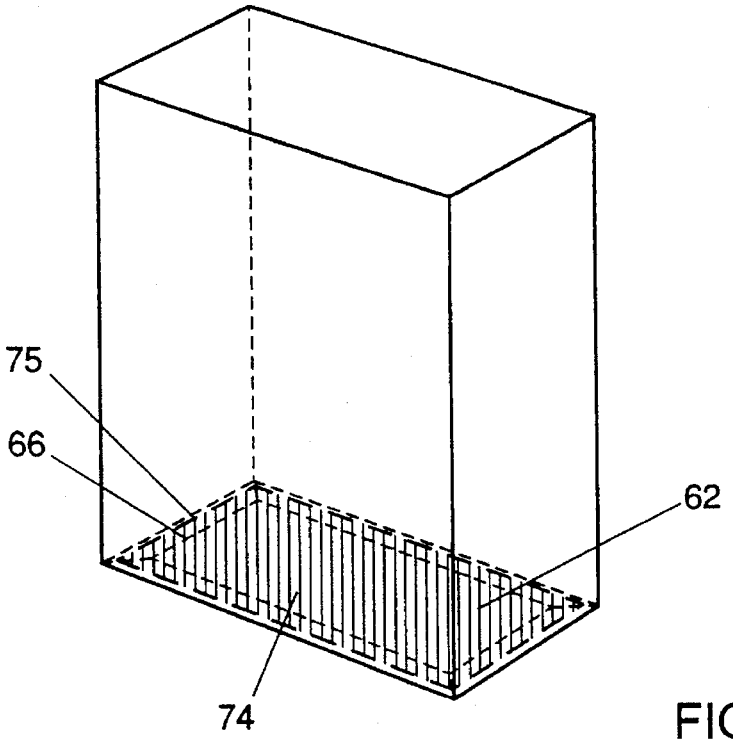
FIG. 9 is a perspective view of second embodiment of a vacuum package manufactured with the apparatus of FIG. 1.
Figure 10:
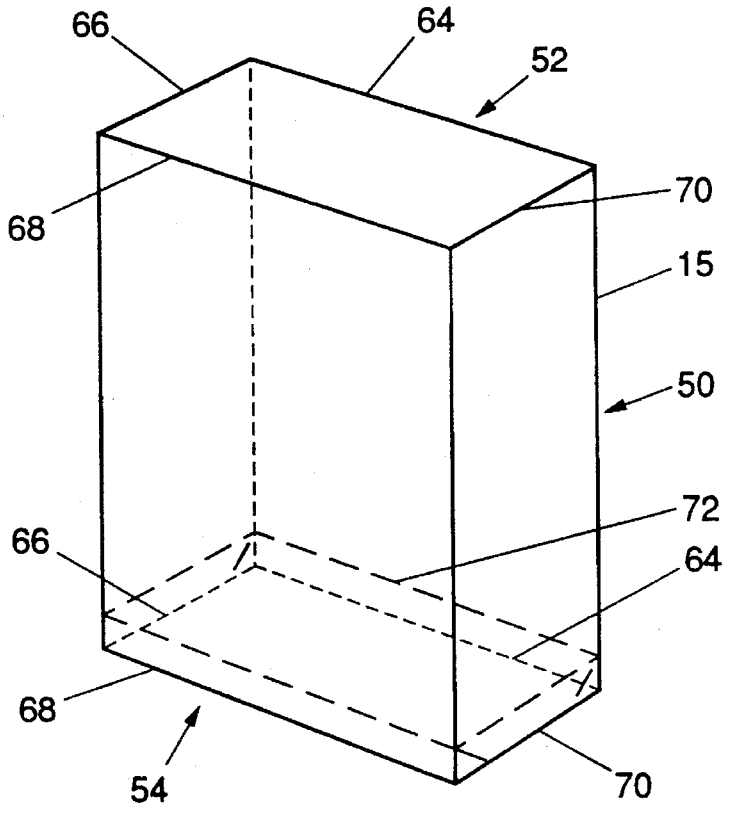
FIG. 10 is a perspective view of an intermediate of the vacuum package of FIG. 9.

With reference to FIGS. 9 and 10, a second embodiment of the package 15 will now be discussed, which comprises a bottom 62 which is particularly advantageous in accordance with the invention. Parts corresponding with those in FIGS. 7 and 8 have been given the same reference numerals.

FIG. 10 shows the open shell 50 with two open ends 52, 54 from which the as yet unfinished package of FIG. 9 is produced, i.e. before a bottom is provided in the package. Four edges 64–70 have been folded inwards along fold lines 72 indicated by broken lines in FIG. 10. FIG. 10 shows the edges 64–70 in unfolded condition and FIG. 9 shows them in inwardly folded condition. The package 15 of FIG. 9 further shows an insert sheet 74 which, adjacent its circumferential edges 75 indicated by broken lines in FIG. 9, is airtightly connected to the edges 64–70 of the shell 50. In FIG. 9 the insert sheet 74 is hatched. In FIG. 9 the insert sheet 74 is connected on the inside of the package to the edges 64–70 of the shell 50, but it may also be airtightly connected on the outside of the shell 50 to the edges 64–70. The attachment can be implemented airtightly again in a manner which is known per se using, for instance, a welding device. For this purpose, it is for instance possible to support the inside of the package with a rigid object fitting into the package, so that the insert sheet 74 can be pressed against the edges 66 sufficiently firmly for making the airtight connection. The insert sheet 74 can be provided both on the inside and on the outside of the edges 64–70. This distinction is not depicted in FIG. 9.

After the package 15 according to FIG. 9 has been filled with the granular product, the open end 52 at the top of the package can be closed as discussed with reference to the package shown in FIG. 7. However, it is also possible to hermetically seal the open end 52 of the package shown in FIG. 9 with an insert sheet as shown at the open end 54 of this package. Since at the time of the closure of the open end 52 with an insert sheet the package 15 is filled with the contents in question, the insert sheet will preferably be attached on the outside of the edges adjacent the open end 52 (not shown in FIG. 9). During the manufacture of the package, the filling of the package 15 can offer sufficient resistance for the insert sheet in question to be pressed firmly against the edges when it is being attached to the edges using, for instance, a welding device.

Figure 11:
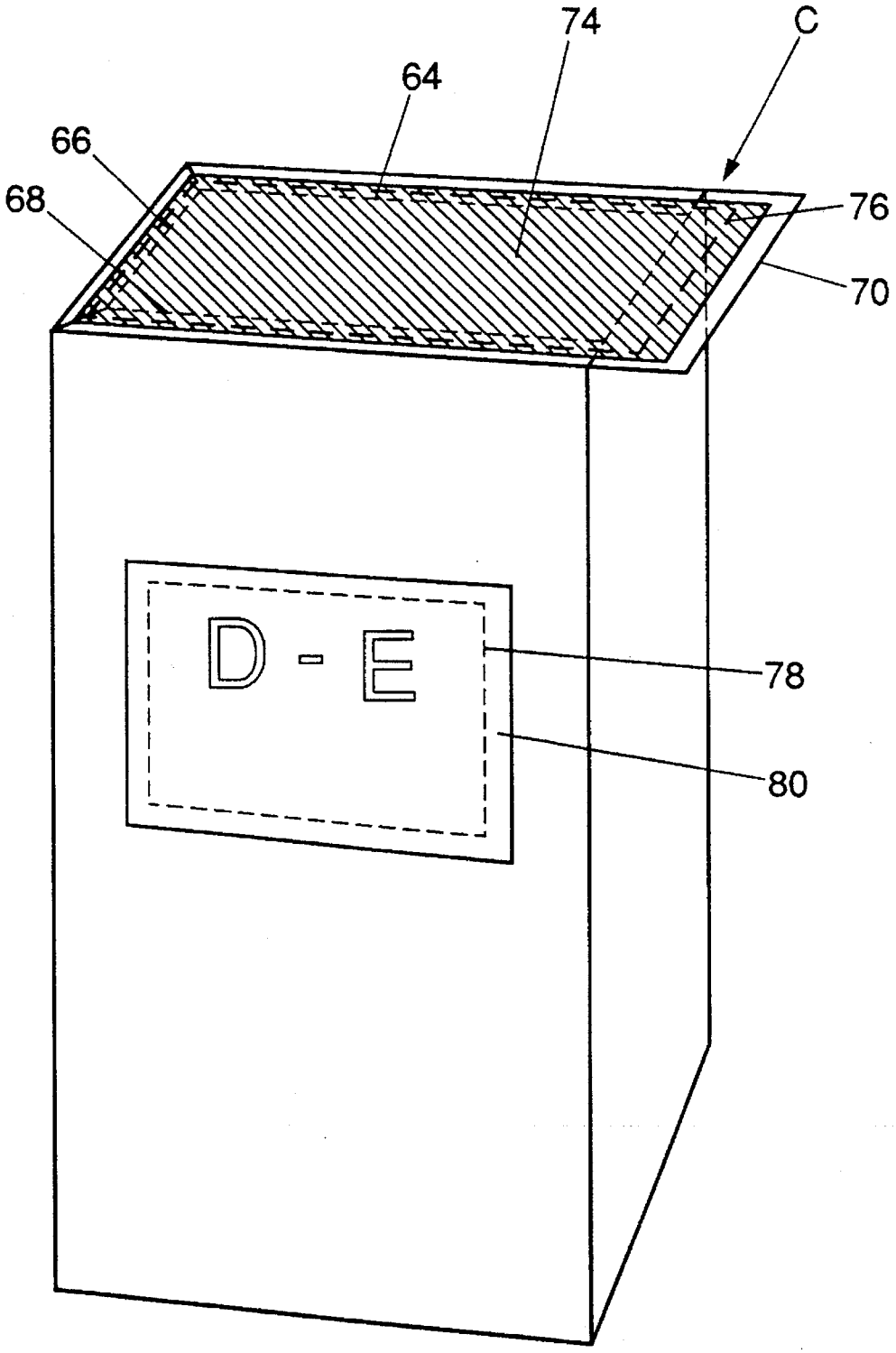
FIG. 11 is a perspective view of a third embodiment of a vacuum package manufactured with the apparatus of FIG. 1.
Figure 12:
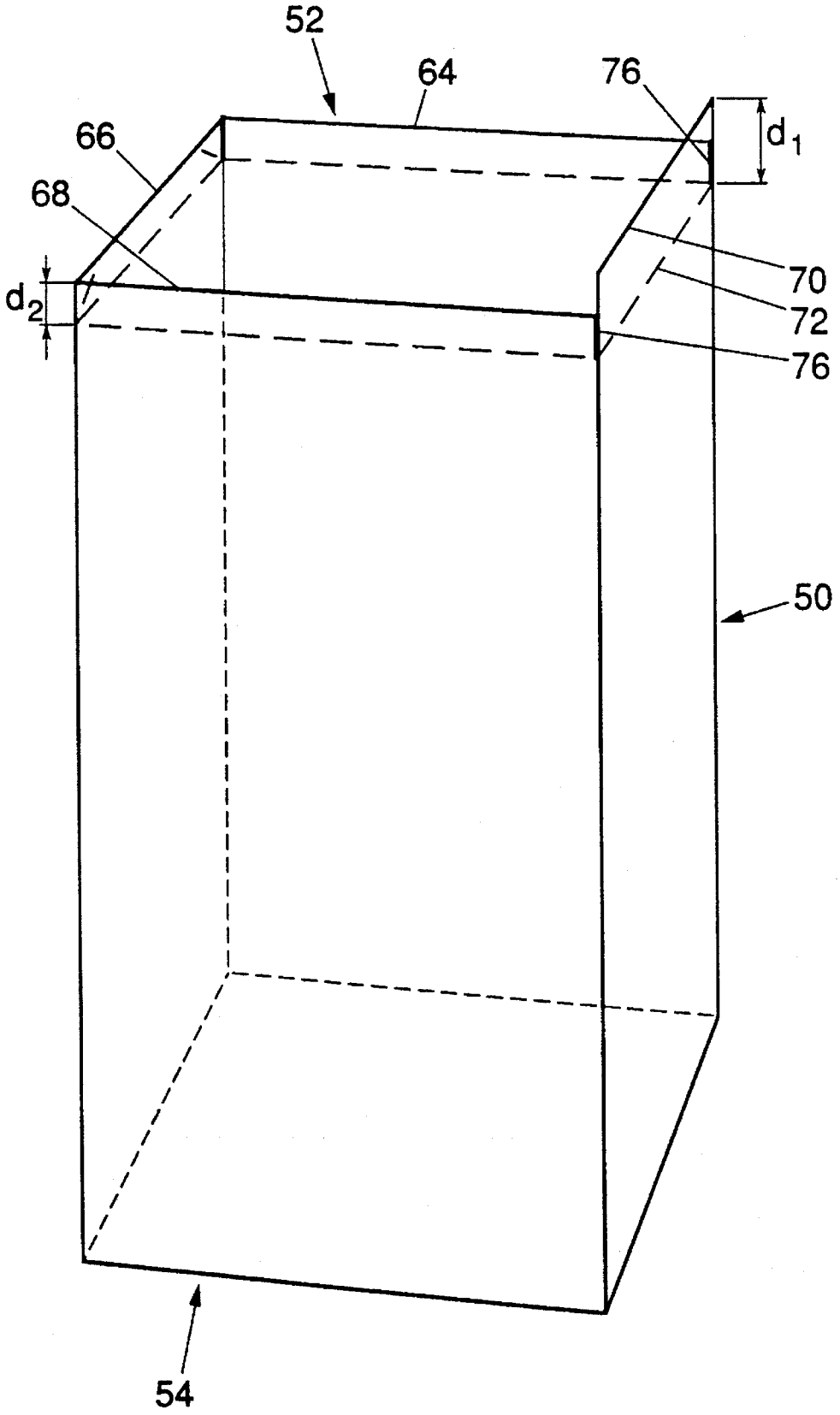
FIG. 12 is a perspective view of an intermediate of the vacuum package of FIG. 11.

FIGS. 11 and 12 show a third embodiment of the package 15, parts corresponding with FIGS. 7 and 8 being indicated by the same reference numerals. At the top of the package, three edges 64–68 have been folded inwards and an edge 70 has been folded outwards. FIG. 12 shows the open shell 50 with two open ends 52, 54, from which the as yet unfinished package of FIG. 11 can be produced. FIG. 12 shows the edges 64–70 in unfolded condition, the fold lines 72 being indicated by broken lines. The shell 50 further comprises two cuts 76, depicted in bold type, enabling the edge 70 to be folded outwards. The top of the package is provided with an insert sheet 74 which is airtightly connected to the outside of the edges 64–68 and the inside of the edge 70. Preferably, the width d1 of the edge 70 is greater than the width d2 of the other edges 64–68. The insert sheet 74 is only connected to the edge 70 at its edges, as indicated in FIG. 11 by means of broken line 76. This enables the package to be readily opened, for instance by cutting off the edge 70 and the insert sheet 74 along the line C. Naturally, the width d1 can also be chosen to be equal to the width d2. For the sake of completeness, it is further noted that the bottom of the package according to FIG. 11 may be provided with an insert sheet as discussed with respect to the top of the package. It is also possible, however, for the bottom to be provided with an insert sheet as shown in FIGS. 9 and 11, respectively. Naturally, the bottom 54 of the package according to FIG. 11 can also be formed from the shell 50 in the manner of the bottom of the package 15 discussed with reference to FIG. 7.

As shown in FIG. 11, for instance, the shell 50 may further be provided with an opening 78 depicted as a broken line. Adjacent the edges of the opening, an insert sheet 80 has been airtightly connected to the shell 50, for instance with the aid of a welding device. The insert sheet in question may beforehand have been provided with characters or pictures, so that they can be of a predetermined desired quality. On the other hand, it is possible for the insert sheet 80 to be made of a different material from the shell 50. The insert sheet may for instance be made of a less flexible film than the shell 50. The insert sheet 80 will then have a less rough surface than the rest of the package. Any pictures and characters on the insert sheet 80 will then be better visible.

It holds for all of the above-described embodiments of a package 15 with an insert sheet 74, 80, that the insert sheet can be made from the same material as or a different material from the shell 50. The packages 15 described hereinbefore are all preferably evacuated as discussed hereinabove.

Furthermore, in accordance with a particular embodiment of the vacuum package 15, the insert sheet 74, 80 may be provided, for instance in the centre thereof, with a welding strip 18, so that evacuation of the finished package can be implemented by means of the apparatus according to FIG. 1. In accordance with a particular embodiment of the invention, a hole has been pierced in the insert sheet beforehand for evacuating the package, whereafter the hole is sealed by providing a welding strip over the hole. Naturally, both the hole and the welding strip can be provided in the insert sheet beforehand, and the welding strip may be located both inside and outside the finished package.

In addition, the hole may also be provided at a position where insert sheet 74 and an edge 64–70 of the shell 50 are attached to each other. After evacuation of the package 15, the hole can be sealed, for instance by heating the location referred to (again), so that the insert sheet and/or shell 50 will at least partly melt, fuse or deliquesce again at that location and the hole will be sealed.

I claim:

1. A method for making a vacuum package filled with granular material, in which a package made from a flexible packaging material and filled with a granular product which directly contacts the flexible packaging material is evacuated and sealed hermetically, characterized in that the package, before being evacuated, is compressed by applying pressure to the sidewalls of the package, so that the granular product forms a compact whole, that a suction opening in the otherwise airtight package is formed in a wall of the package by providing a perforation in said walls of the package, that the perforation is provided by a needle capable of moving back and forth, arranged in a vacuum element, that subsequently the vacuum element is connected to the suction opening provided in the wall of the package, said vacuum element evacuating the package through the suction opening without the package being otherwise externally subjected to vacuum, and that after the evacuation the suction opening is sealed hermetically by a sealing element arranged in the vacuum element.

2. A method according to claim 1, characterized in that the suction opening in the otherwise airtight package is formed by providing a perforation in one of the walls of the package.

3. A method according to any claim 1, characterized in that the package, for the purpose of implementing said compression, is placed in a bag-shaped body made of elastic material and of double-walled design, said bag-shaped body being inflated by the supply of compressed air between the double walls, so that the inner wall of the bag-shaped body is pressed against the package.

4. A method according to claim 1, characterized in that the package is compressed by pressing rigid plate-shaped elements, capable of moving back and forth, against the walls of the package.

5. A method according to claim 4, characterized in that said plate-shaped elements are arranged between the inner wall of the bag-shaped body and the outside of the package.

6. A method according to any of claims claim 1, characterized in that during the compression of the package the bottom and top faces of the package are pressed towards each other as well.

7. A method according to claim 1, characterized in that a welding strip is provided under the suction opening between the inside wall of the package and the filling, and that after evacuation the suction opening is sealed hermetically by welding the welding strip around the suction opening to the inside wall of the package.

8. A method according to claim 7, characterized in that the welding strip comprises a plurality of openings located outside the zone for said welding, the suction opening being in communication with the interior of the package through said openings during evacuation.

9. A method according to claim 1, characterized in that after the evacuation of the package a sealing strip is fitted onto the suction opening on the outside of the package.

10. A method according claim 1, characterized in that at a location of informational characters on the packaging material of the package, a reinforcement zone is provided between the packaging material and the granular product before the package is evacuated, so that at that location the roughness of the surface of the packaging material after evacuation is reduced and the legibility of the informational characters is improved.

11. A method according to claim 10, characterized in that the reinforcement zone is provided before the package is compressed by said application of pressure to the sidewalls of the package.

12. A method according to claim 10, characterized in that the reinforcement zone is substantially provided only under the portion of the packaging material with informational characters.

13. A method according to claim 12, characterized in that the reinforcement zone is provided with relief characters, the packaging material during evacuation being pressed against the relief characters under the influence of the pressure difference across the package and the relief characters becoming visible on the outside of the wall.

14. A method according to claim 10, characterized in that the reinforcement zone is provided under a portion of the packaging material that is provided with a bar code.

15. A method according to claim 10, characterized in that a plate-shaped element is arranged between the filling and the packaging material for forming the reinforcement zone.

16. A method according to claim 10, characterized in that the packaging material is provided with a thickened portion for forming the reinforcement zone.

17. A method according to claim 1, characterized in that the package, before being evacuated, is formed from at least two different sheets of packaging material, at least one basic sheet thereof determining at least substantially the outward form of the package and at least one insert sheet being connected adjacent its circumferential edges to the basic sheet in a manner to form a substantially closed container with at least the basic sheet.

18. A method according to claim 17, characterized in that the basic and insert sheets consist of different types of packaging material.

19. A method according to claim 17, characterized in that the suction opening is provided in the insert sheet.

20. A method according to claim 19, characterized in that the perforation is provided adjacent the edge of the insert sheet in the basic and insert sheets.

21. A method according to claim 20, characterized in that the perforation, after evacuation of the package, is hermetically sealed by heating the basic and insert sheets at the perforation, in such a manner that the basic and/or insert sheets separate at least partly at that location.

22. A method according to claim 17, characterized in that the basic sheet is folded into a shell, an edge of the basic sheet extending in the longitudinal direction of the shell is hermetically connected to subjacent material of the basic sheet, at least a portion of an edge of the basic sheet adjacent a first open end of the shell is folded over and the insert sheet is hermetically connected to the folded portion of the basic sheet.

23. A method according to claim 22, characterized in that the package is subsequently filled with the granular material through a second open end of the shell, whereafter the second open end is folded up and hermetically sealed.

24. A method according to claim 22, characterized in that the package is subsequently filled with the granular material through a second open end of the shell, whereafter at least a portion of an edge of the basic sheet adjacent the second open end of the shell is folded over and a second insert sheet is hermetically connected to the folded portion of the edge.

25. A method according to claim 22, characterized in that at least a portion of the edge of the basic sheet is folded towards the inside of the shell.

26. A method according to claim 22, characterized in that at least a portion of the edge of the basic sheet is folded towards the outside of the shell, so that upon attachment of the insert sheet a flap is obtained on the package, which flap can be readily cut off for opening the package.

27. An apparatus for producing a vacuum package filled with granular material, comprising a vacuum element for evacuating a package made from a flexible packaging material and filled with granular material, which directly contacts the flexible packaging material, and closing means for hermetically closing the filled package, characterized in that the apparatus further comprises pressure means for applying pressure to at least the sidewalls of the closed package, so that the granular filling forms a compact whole, and that the vacuum element is adapted to be connected to a suction opening, provided in a wall of the closed and compressed package, for evacuating the package which is not otherwise subjected to vacuum, and that the closing means are adapted for hermetically sealing the suction opening, wherein the vacuum element comprises a needle capable of moving back and forth for piercing the package for forming the suction opening and a sealing element for sealing the suction opening.

28. An apparatus according to claim 27, characterized in that the pressure means is formed by a bag-shaped body, made from elastic material and of double-walled design, for placing the package therein, and a line for supplying compressed air between the walls of the bag-shaped body is connected to the bag-shaped body for inflating the bag-shaped body, so that the inner wall thereof is pressed against the package.

29. An apparatus according to claim 28, characterized in that interconnected plate-shaped elements capable of moving back and forth are arranged within the bag-shaped body, said plate-shaped elements forming a holder for the package to be placed therein and being pressed against the walls of the package as a result of the inflation of the bag-shaped body, for the purpose of compressing the package.

* * * * *